US006442764B1

(12) United States Patent
Badillo et al.

(10) Patent No.: US 6,442,764 B1
(45) Date of Patent: Sep. 3, 2002

(54) MULTI-USE CAP WITH TAB FOR HOLDING ACCESSORIES

(75) Inventors: Paul Badillo; Sandra Martinez, both of Littleton, CO (US)

(73) Assignee: Intelligent Designs 2000 Corp., Denver, CO (US)

( * ) Notice: Subject to any disclaimer, the term of this patent is extended or adjusted under 35 U.S.C. 154(b) by 0 days.

(21) Appl. No.: 09/917,502

(22) Filed: Jul. 27, 2001

Related U.S. Application Data

(60) Provisional application No. 60/221,616, filed on Jul. 28, 2000.

(51) Int. Cl.[7] ..... A42B 1/24

(52) U.S. Cl. ..... 2/209.13; 2/195.1; 2/175.7; 362/105; 362/106

(58) Field of Search ..... 2/171, 209.11, 2/209.12, 209.13, 175.1, 195.1, 209.14, 175.2, 175.3, 175.7; 362/105, 106

(56) References Cited

U.S. PATENT DOCUMENTS

| | | | | |
|---|---|---|---|---|
| 1,109,415 A | | 9/1914 | Harris | |
| 1,540,345 A | | 6/1925 | Kowasik | |
| 1,744,777 A | | 1/1930 | Lundgren | |
| 2,131,617 A | | 9/1938 | Cowden | |
| 2,473,394 A | | 6/1949 | Scott | |
| D176,073 S | | 11/1955 | Mantell | |
| 2,744,256 A | | 5/1956 | Slotkin et al. | |
| 4,168,544 A | * | 9/1979 | Kallman | 2/69 |
| 4,718,126 A | | 1/1988 | Slay | |
| 5,053,932 A | | 10/1991 | Case | |
| 5,386,592 A | | 2/1995 | Checkeroski | |
| 5,567,039 A | * | 10/1996 | Sims | 362/106 |
| D384,789 S | | 10/1997 | Crabb et al. | |
| 5,738,431 A | * | 4/1998 | Lary | 362/106 |
| 5,894,604 A | * | 4/1999 | Crabb et al. | 2/209.13 |
| 5,933,871 A | * | 8/1999 | Kraft | 2/209.13 |
| 6,206,543 B1 | * | 3/2001 | Henry | 2/209.13 X |

* cited by examiner

*Primary Examiner*—Gloria M. Hale
(74) *Attorney, Agent, or Firm*—Sheridan Ross P.C.

(57) ABSTRACT

A type of lightweight, multi-use headware is provided which has a concealable elastic loop on one or both sides of the headware for temporarily receiving a small illuminating device that allows the handle of the illuminating device to be securely held within the elastic loop of the headware. When the illuminating device is removed from the elastic loop, the loop may be concealed within the headware so that the headware may be used in the more traditional manner of shielding the user's face and eyes from sunlight.

14 Claims, 5 Drawing Sheets

MULTI-USE CAP WITH TAB FOR HOLDING ACCESSORIES

CROSS REFERENCE TO RELATED APPLICATIONS

Priority is claimed from U.S. Provisional Patent Application No. 60/221,616 filed on Jul. 28, 2000, and entitled "MULTI-USE CAP WITH TAB FOR HOLDING ACCESSORIES", the disclosure of which is incorporated herein by reference in its entirety.

FIELD OF THE INVENTION

The invention relates to headware, and particularly to a cap or hat which is constructed to temporarily hold a handle portion of an illuminating device in a concealable tab. When the illuminating device is removed from the headware, the concealable tab may be concealed along the sweatband of the cap, and the cap or hat may be used for its more traditional purpose of shielding the sun from the face of a user.

BACKGROUND OF THE INVENTION

The use of portable flashlights for illumination purposes are well known and frequently used by hunters, fisherman, miners, fireman and others having a particular task to perform in the darkness. To permit the user of the flashlight to have both hands free to perform a designated task, it has been found advantageous to have the flashlight securely connected to headware worn by the user of the flashlight. This type of attachment allows the illuminating beam of light to be constantly positioned in the users direction of sight.

The headware used for the attachment of a flashlight has commonly been in the form of a rigid hardhat, or helmet with an exterior bracket for attaching the flashlight, batteries to operate the flashlight, or both. One type of configuration has a flashlight attached to the hardhat with a wire connected to a battery pack worn on the belt of the user. Another type of design has the batteries attached on the rear exterior surface of the hardhat. These types of configurations are generally heavy, cumbersome, and have a tendency to permit either the handle portion of the flashlight, the batteries attachment bracket, or wiring to become snagged or hooked on surrounding limbs from trees or shrubs or on other objects.

Another type of flashlight holder which may be worn around the users' head utilizes a headband or strap which attaches to a small flashlight. Although these apparatus are much lighter and less cumbersome to wear than the rigid hats described above, they do not adequately secure the flashlight to the user's head, and are additionally prone to snagging objects such as limbs or twigs due to the flashlight handle projecting from the strap. Furthermore, the headband type of flashlight holder does not have any other utility besides holding the flashlight. For example, the headband cannot be used to shield the sun from a user's eyes, provide protection to the user's head from the weather, or provide protection in the case of a hard hat.

Thus, a need exists for a type of headware, and more particularly a cap or fedora to be constructed in a manner which allows a small flashlight handle to be temporarily and concealably secured to the hat in a manner which alleviates the flashlight handle from snagging other objects, yet is compatible for the user to inconspicuously wear the hat for other uses such as shielding the sun or protection from the weather.

SUMMARY OF THE INVENTION

It is thus one aspect of the present invention to provide a type of lightweight, non-rigid hat or headware with means for attaching an illumination device in a manner which is non-obtrusive and not likely to snag on surrounding objects. It is a further aspect of the present invention to provide headware that inconspicuously houses the means for attaching an illumination device when not in use. It is yet a further aspect of the invention that the headware be capable of dual use during both nighttime and daytime conditions.

Thus, in one aspect of the present invention, a lightweight cap or fedora is constructed in a manner which allows the handle portion of a small flashlight to be interconnected to an expandable or elastic loop or tab attached to the interior of the cap. The illumination device or flashlight is temporarily secured to the elastic loop, and thus the cap, in a manner which permits the flashlight to be easily removed for other uses, and once removed, the loop can be replaced into the shell of the cap such that the cap is substantially indistinguishable from caps currently used by sportsmen, police officers and others who work or enjoy recreational activities in the dark.

Thus, it is an additional aspect of the present invention that the cap be designed to appear substantially similar to commonly worn baseball type caps or fedora hats which may be used for its generally accepted purpose of shielding the users face from the sun during daylight. However, a means for securing a flashlight within the cap is provided which is inexpensive to manufacture, comfortable for the user and allows a traditional cap to be used for a dual purpose.

In another aspect of the invention, the securement of the flashlight handle is accomplished in a manner which maintains the flashlight in close proximity to the user's head. This configuration is not only aesthetically pleasing, but more importantly, generally prevents the handle portion of the flashlight from being snagged or hooked by adjacent objects such as tree limbs, and permits the cap and attached flashlight to be worn in confining spaces. This configuration further allows the beam of light from the flashlight to be directed toward the user's line of sight.

It is a further aspect of the invention that a small flashlight may be secured on either side of the hat or both sides if the user requires additional illumination. Thus, the invention allows a user to customize the use of the hat for whatever particular use is preferred.

To secure the flashlight to the headware, an expandable type fabric is generally interconnected to the base surface of the cap between the shell of the cap and the sweatband of the cap. The material forms a loop or a sleeve which is sized to specifically hold a small flashlight, and is generally stitched, glued, or heat bonded to the cap for securement purposes. To form the loop, a standard elastic strip of the desired length may be simply cut to the appropriate length, folded to form a loop, and sewn, adhered, or otherwise interconnected to the cap shell. The sweatband is secured, generally by stitching or adhesive, to the shell of the cap along the circumference of the base of the cap. However, the sweatband is not secured to the shell of the cap along the length of the interconnection of the elastic loop, thereby creating a defined space between the shell and the sweatband for receiving the expandable loop in a first position of storage. This allows an opening or aperture between the sweatband and the shell of the cap such that the elastic loop may be folded up into the cap between the shell and the sweatband when not in use.

Alternatively, the elastic loop may be attached to the sweatband rather than the shell of the cap. This alternative embodiment maintains the aperture between the sweatband and the shell of the cap for insertion and concealment of the elastic loop. However, this embodiment may simplify assembly since the attachment of the elastic loop to the sweatband involve smaller and more manageable pieces of the cap than working with the cap itself at this stage of manufacturing.

DETAILED DESCRIPTION OF THE PREFERRED EMBODIMENT

Figure 1:
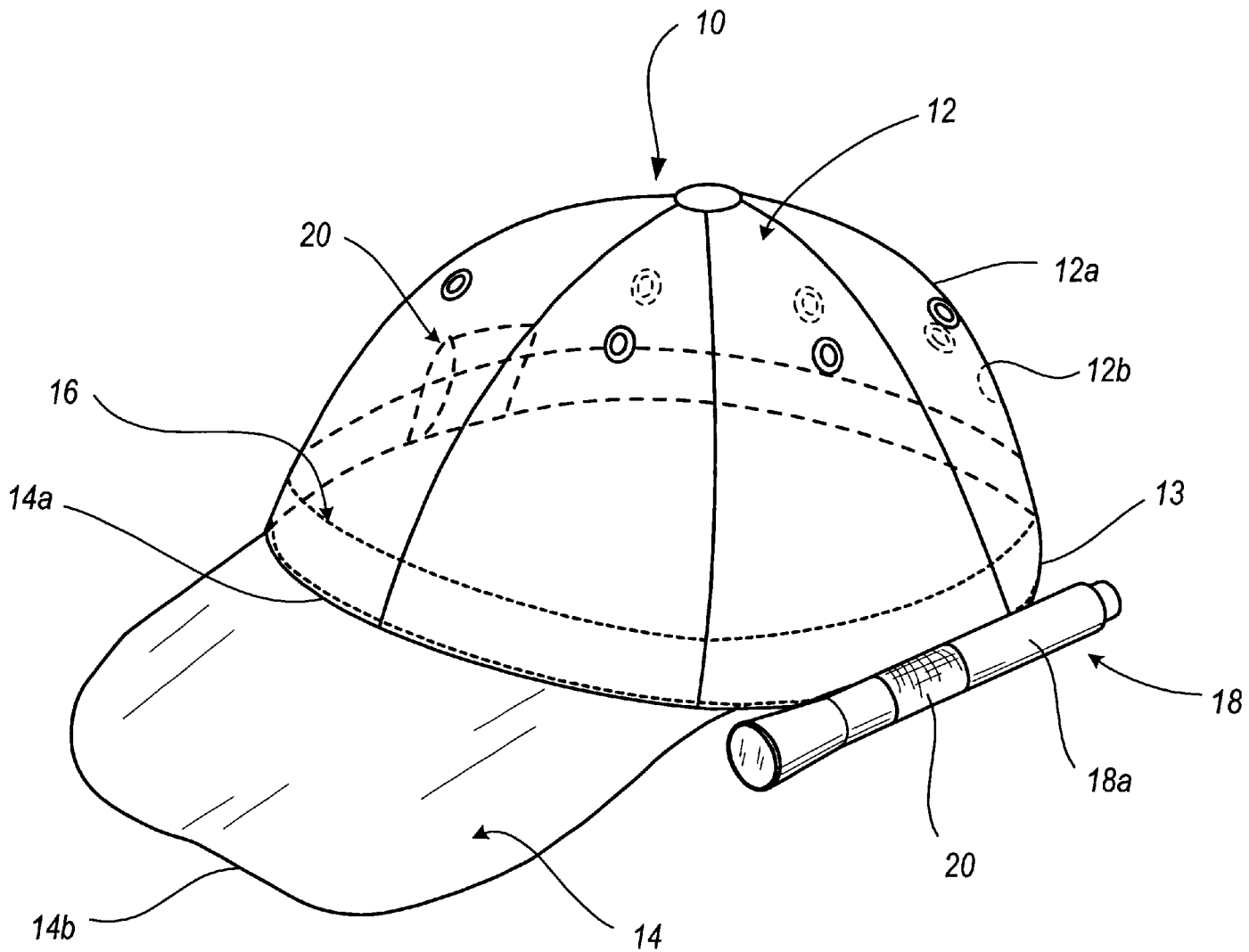
FIG. 1 is a front perspective view of one embodiment of the present invention.

Referring now to the drawings, FIG. 1 shows one embodiment of the present invention in a front perspective view. In this embodiment the cap 10 is shown comprising generally a shell 12, a brim 14, and a sweatband 16. The shell 12 having an exterior surface 12*a,* an interior surface 12*b,* and a circumferential base 13. The brim 14 having a base end 14*a* and a visor end 14*b*. In a manner typical of the construction of a cap, the base end 14*a* of brim 14 is attached to the circumferential base 13 of shell 12. A handheld flashlight 18 having a longitudinal handle portion 18*a* is secured to the cap 10 by a concealable expandable or elastic loop 20. The handheld flashlight 18 may be inserted into the concealable elastic loop 20 by expanding the elastic loop 20 to accommodate the handle portion 18*a* of the handheld flashlight 18. Once the elastic loop 20 is allowed to naturally contract, the flashlight 18 is securely held by the elastic loop 20.

FIG. 1 also shows the alternative embodiment of the multiple use of elastic loops 20 within a single cap 10. This alternative embodiment allows the user to select the most convenient location for the handheld flashlight 18 relative to the user's head. The selection may be based on the type and position of the task to be performed by the user, or may be based on which of the user's dominant eyes is being used in conjunction with firing a weapon or using a tool. Additionally, multiple flashlights 18 may be desirable to provide additional light to accomplish the task at hand.

Figure 2:
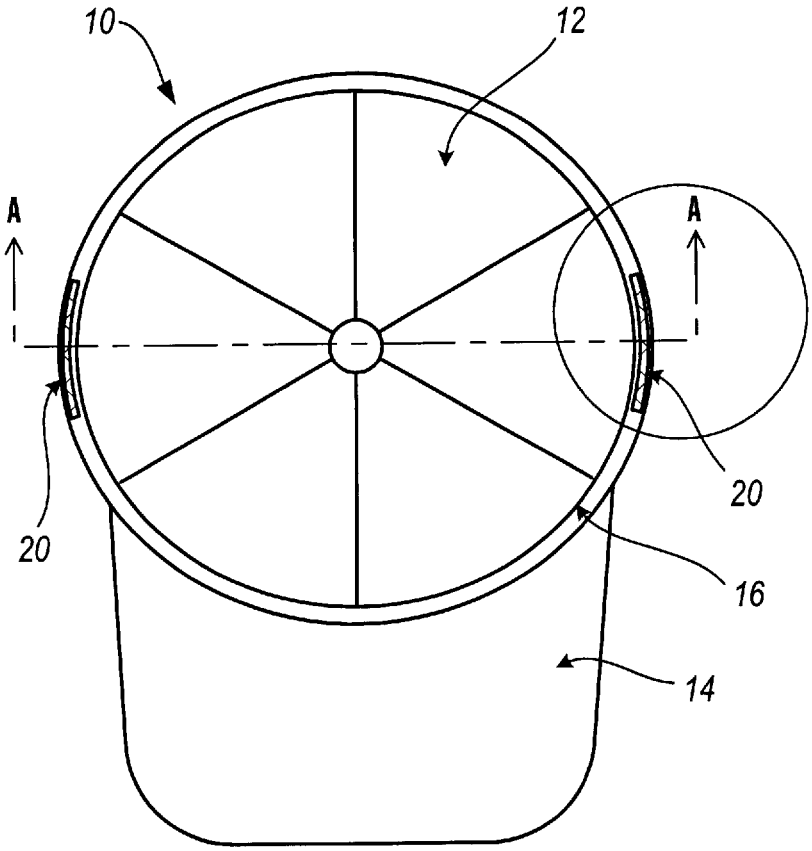
FIG. 2 is a bottom view of the embodiment shown in FIG. 1.

FIG. 2 is a bottom view of the embodiment of FIG. 1. FIG. 2 shows more clearly the position of the elastic loop 20 relative to the sweatband 16.

Figure 3:
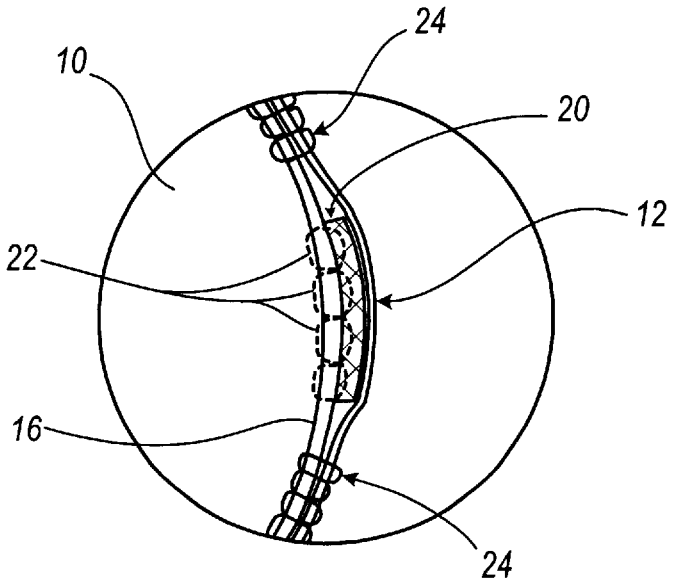
FIG. 3 is an exploded view of a portion of the bottom view shown in FIG. 2.

FIG. 3 is an enlarged view of a portion of FIG. 2. FIG. 3 clearly shows the relative positions of the cap shell 12, the concealable elastic loop 20, and the sweatband 16. FIG. 3 also shows an alternative embodiment of the attachment means for the concealable elastic loop 20 to the cap 10. In this embodiment, the elastic loop 20 is attached to the sweatband 16 by the elastic loop stitching 22. The elastic loop stitching 22 connects only the elastic loop 20 to the sweatband 16.

In this particular embodiment shown in FIG. 3, the sweatband 16 is attached to the cap shell 12 by the shell stitching 24. The shell stitching 24 is provided along the entire circumference of the cap shell 12 except for the length of the elastic loop 20. The absence of the shell stitching 24 along the length of the elastic loop 20 provides an aperture between the cap shell 12 and the sweatband 16 wherein the elastic loop 20 can be inserted and concealed during periods of non-use.

An alternative embodiment to that shown in FIGS. 1–4 consists of providing an aperture or slit in a shell 12 of cap 10 wherein the expandable loop 20 is withdrawn from a first position of storage, and is thereby exposed to the exterior of shell 12 to a second position of use. In this particular embodiment, shell stitching 24 may extend around the entire circumferential base 13 of shell 12.

A further alternative embodiment to that shown in FIGS. 1–4 consists of positioning the elastic loop 20 interior of the sweatband 16. In this alternative embodiment, the elastic loop 20 would be situated between the user's head and the sweatband 16. When the user desires to use the flashlight holding feature, the user folds down the elastic loop 20 and subsequently inserts flashlight 18 into elastic loop 20. Accordingly, this alternative embodiment does not require an aperture through which the elastic loop 20 must pass to be utilized.

Figure 4A:
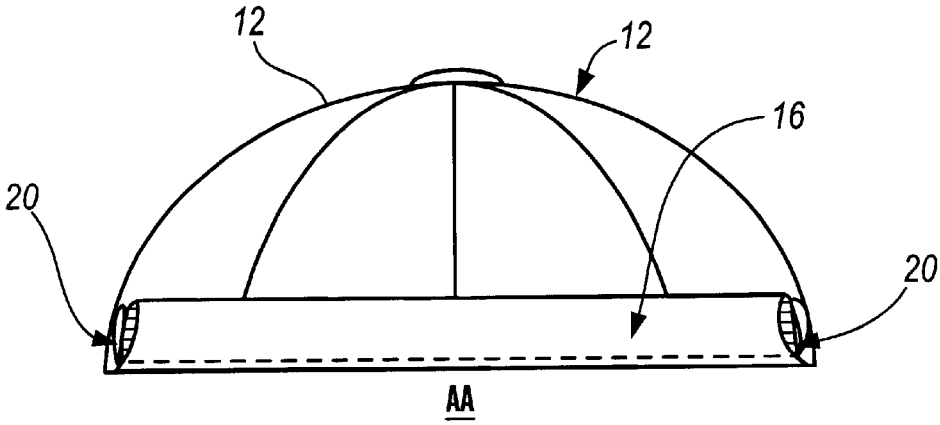
FIG. 4*a* is a cross-sectional view of the embodiment shown in FIG. 2 at line "AA" with the elastic loops shown in the concealed position.

FIGS. 4*a,* 4*b,* and 4*c* are cross-sectional views of the cap 10 from FIG. 2 with the concealable elastic loops 20 shown in various positions. In FIG. 4*a,* the concealable elastic loops 20 are shown in the retracted or concealed first position. As shown in FIG. 4*a,* the elastic loops 20 are virtually unnoticeable when concealed.

Figure 4B:
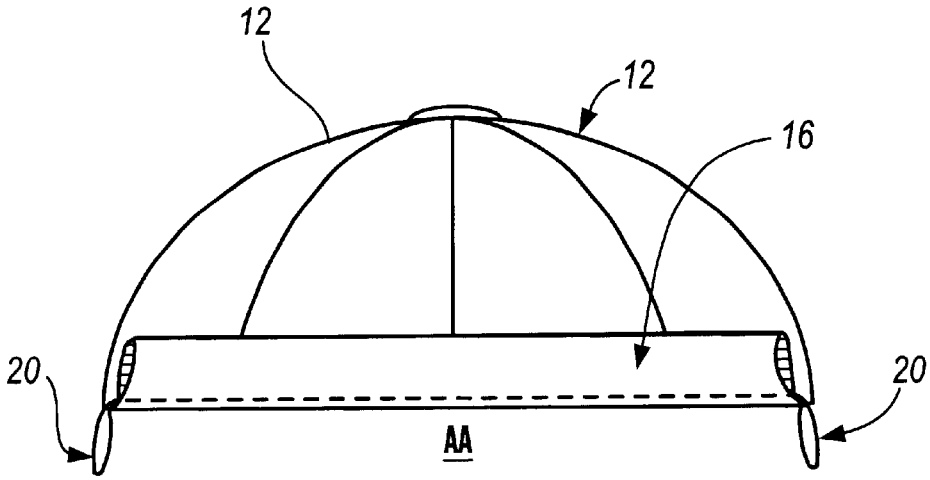
FIG. 4*b* is a cross-sectional view of the embodiment shown in FIG. 2 at line "AA" with the elastic loops shown in the exposed position.
Figure 4C:
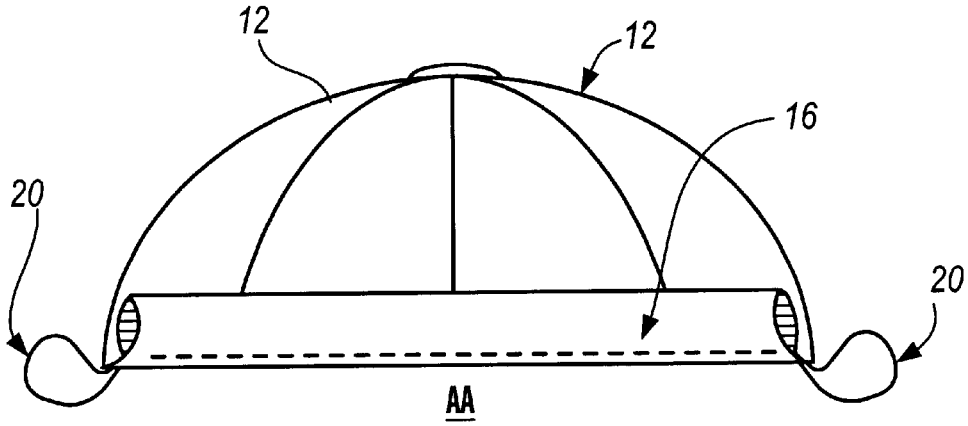
FIG. 4*c* is a cross-sectional view of the embodiment shown in FIG. 2 with the elastic loops shown in the exposed view and expanded to receive a flashlight.

FIG. 4*b* shows the concealable elastic loops 20 in their lowered position. FIG. 4*c* shows the concealable elastic loops 20 in their lowered second position expanded and ready to receive a flashlight 18. Once a flashlight 18 is inserted, the elastic loops 20 are allowed to contract naturally and the elastic loops 20 will secure the flashlight 18 to the cap 10. FIG. 4*c* further shows the close proximity in which the elastic loops 20 maintain the flashlight 18 relative to the cap shell 12. This close proximity reduces the possibility of either the flashlight 18 or the elastic loops 20 snagging or hooking on objects near the user's head.

Figure 5:
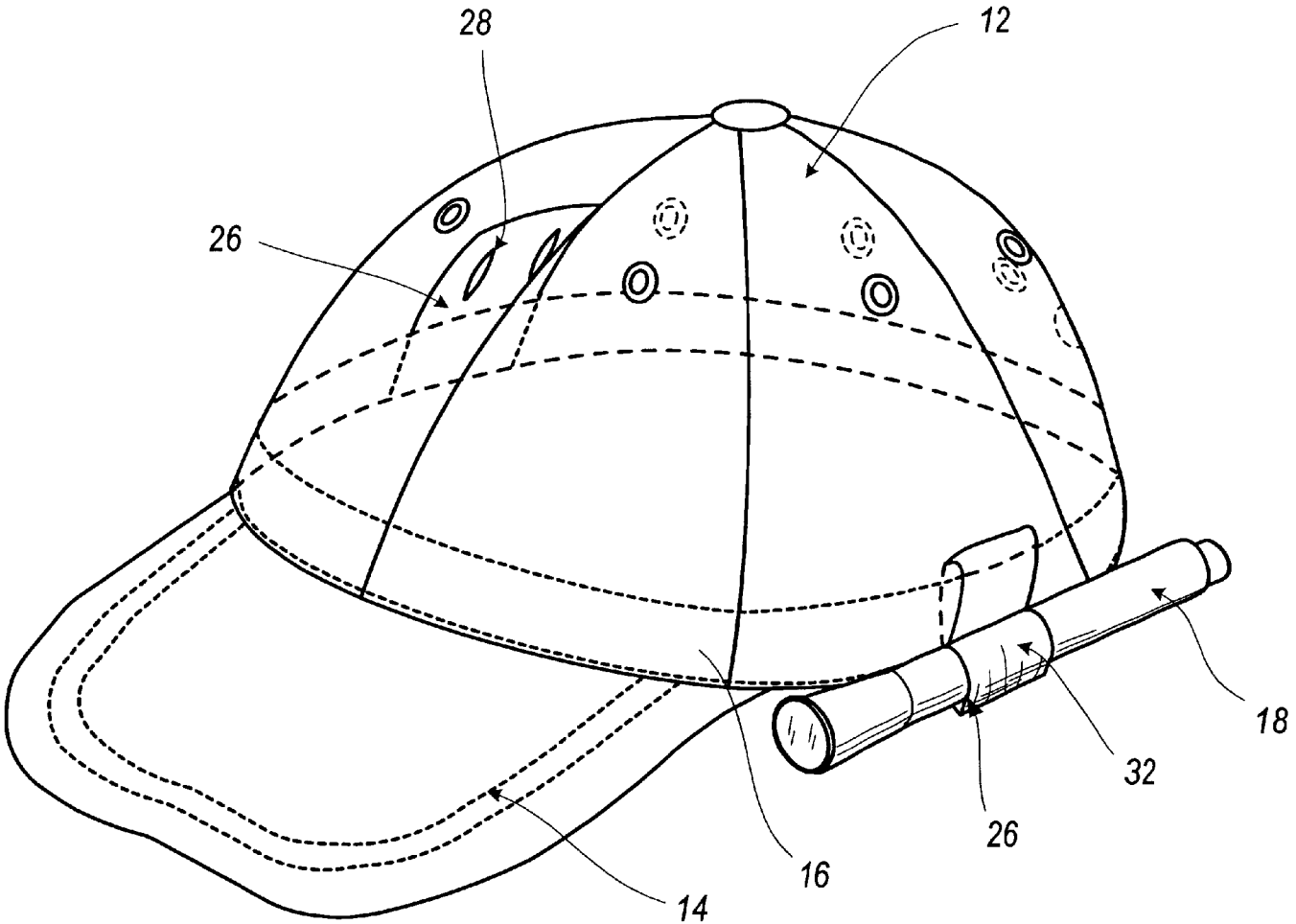
FIG. 5 is a front perspective view of the cap and identifying a rubber strip with slits for receiving a flashlight.
Figure 7:
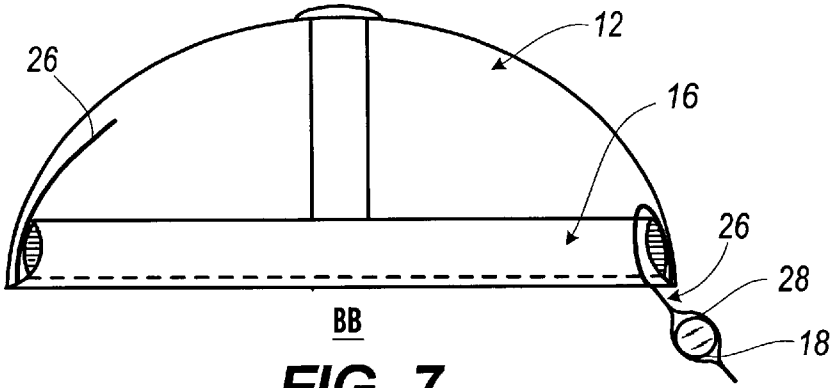
FIG. 7 is a sectional view of FIG. 6, taken at line BB.
Figure 8:
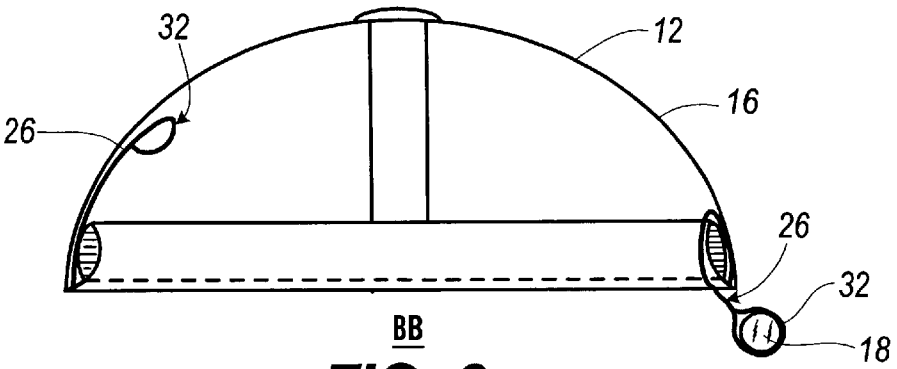
FIG. 8 is sectional view of FIG. 6, taken at line BB, and showing one of the rubber strips suspended for receiving a handheld flashlight.
Figure 6:
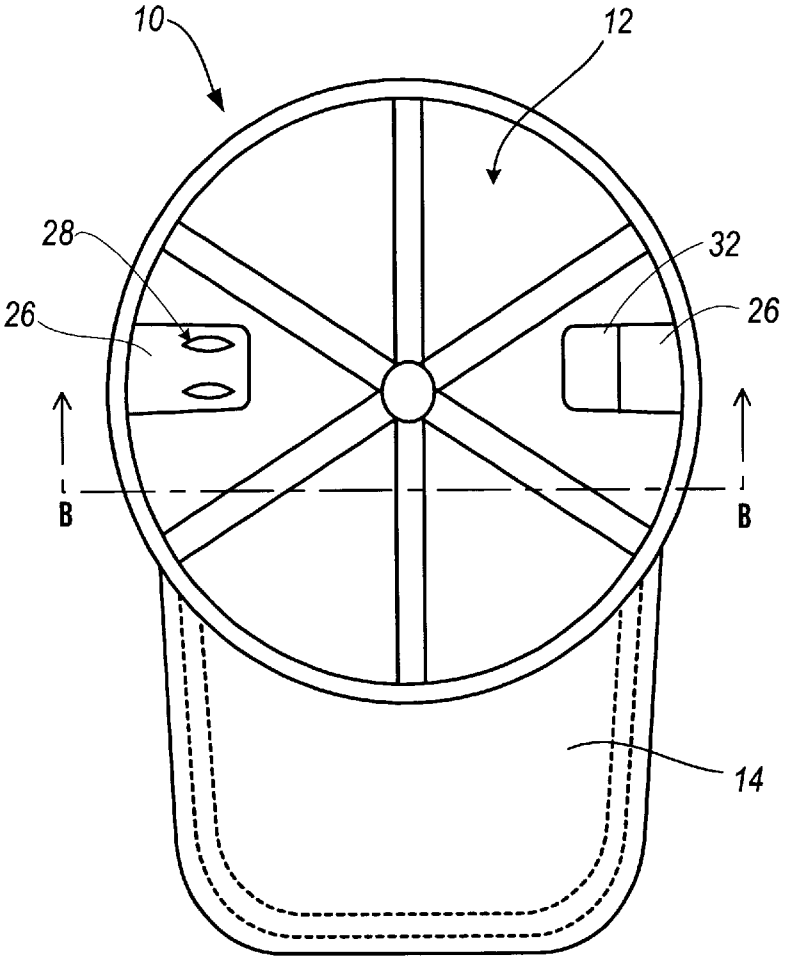
FIG. 6 is a bottom plan view of the embodiment shown in FIG. 5, and identifying the rubber slits in a position of non-use.

FIGS. 5–8 show an alternative embodiment of the present invention. More specifically, a rubber strip 26 is provided which has either two slits 28 positioned to receive the handle of a flashlight 18, as depicted in FIGS. 5–7, or alternatively, a rubber loop 32 is provided to receive the handle of a flashlight 18, as depicted in FIGS. 5, 6, and 8. When not in use, the rubber strip 26 is conveniently stored in a non-visible position within the cap 10, and preferably behind the sweatband 16 for comfort purposes. During use, the rubber strip is merely pulled downward to expose either the slits 28 or the loop 32 which is adapted for holding the flashlight 18.

The rubber strip 26 or elastic loop 20 may be attached to the cap 10 either during manufacturing, or may be sold as an after market item to be attached at a later date. The elastic loop 20 or rubber strip 26 may additionally be attached either directly to the sweatband 16 or positioned between the sweatband 16 and the shell 12 of the cap.

What is claimed is:

1. A hat adapted for use with a handheld flashlight, comprising:

a shell, having an interior surface, an exterior surface, and a circumferential base;

a brim, having a base end and a visor end, said base end attached to said shell substantially along said circumferential base; and a first concealable expandable loop for holding a longitudinal handle portion of the handheld flashlight, said first concealable expandable loop interconnected to said shell proximate to said circumferential base on said interior surface of said hat.

2. The hat of claim 1, further comprising a sweatband interconnected to an interior surface of said circumferential base.

3. The hat of claim 2, wherein said first concealable expandable loop can be concealably positioned between said sweatband and said interior surface.

4. The hat of claim 1, wherein said first concealable expandable loop is comprised of rubber.

5. The hat of claim 1, wherein said first concealable expandable loop is comprised of elastic.

6. The hat of claim 1, further comprising a second concealable expandable loop for holding a longitudinal handle portion of a second handheld flashlight and interconnected to said shell proximate said circumferential base and positioned opposite said first concealable expandable loop.

7. The hat of claim 1, wherein said first concealable expandable loop is sewn to said shell.

8. A cap adapted for holding a handheld flashlight, comprising:

a shell having an interior surface, an exterior surface, and a circumferential base; and an expandable loop capable of holding the handheld flashlight and interconnected proximate said circumferential base of said shell, wherein said expandable loop is concealed proximate said interior surface of said shell when said expandable loop is in a first position of storage, and is exposed to the exterior of said shell when said expandable loop is placed in a second position of use.

9. The cap of claim 8, further comprising a brim attached to said circumferential base of said shell.

10. The cap of claim 8, further comprising a sweatband interconnected to said circumferential base of said shell.

11. The cap of claim 8, wherein said shell has an aperture sized for exposing said expandable loop.

12. The cap of claim 10, further comprising a defined space for receiving said expandable loop between said shell and said sweatband, wherein said expandable loop may be operatively received in said defined space when said expandable loop is in said first position of storage.

13. The cap of claim 8, wherein said expandable loop is sewn to said circumferential base of said shell.

14. The cap of claim 10, wherein said expandable loop is sewn to said sweatband.

* * * * *